US010040082B1

(12) United States Patent
Liu

(10) Patent No.: US 10,040,082 B1
(45) Date of Patent: Aug. 7, 2018

(54) COSMETIC CONTAINER HAVING A FIBROUS APPLICATOR

(71) Applicant: Ting Nan Liu, New Taipei (TW)

(72) Inventor: Ting Nan Liu, New Taipei (TW)

(73) Assignee: ZHUHAI DING RONG PLASTIC PRODUCTS CO., LTD, Zhuhai (CN)

( * ) Notice: Subject to any disclaimer, the term of this patent is extended or adjusted under 35 U.S.C. 154(b) by 0 days.

(21) Appl. No.: 15/590,053

(22) Filed: May 9, 2017

(51) Int. Cl.

| | |
|---|---|
| ***A46B 11/04*** | (2006.01) |
| ***B05B 11/00*** | (2006.01) |
| ***A45D 40/00*** | (2006.01) |
| ***A46B 11/00*** | (2006.01) |

(52) U.S. Cl.
CPC ..... *B05B 11/0005* (2013.01); *A45D 40/0075* (2013.01); *A46B 11/0086* (2013.01); *A46B 11/0089* (2013.01); *B05B 11/3001* (2013.01); *B05B 11/3052* (2013.01)

(58) Field of Classification Search
CPC ..... A46B 11/0086; A46B 11/0089
USPC ..... 401/270, 273
See application file for complete search history.

(56) References Cited

U.S. PATENT DOCUMENTS

| | | | | |
|---|---|---|---|---|
| 7,175,360 | B2 * | 2/2007 | Zhang | A45D 34/04 401/186 |
| 7,287,927 | B2 * | 10/2007 | Zhang | B65D 47/42 401/270 |
| 7,988,377 | B2 * | 8/2011 | Zhang | A45D 40/24 401/186 |
| 9,185,959 | B2 * | 11/2015 | Pires | A45D 34/042 |
| 9,867,444 | B1 * | 1/2018 | Liu | A45D 34/042 |
| 2006/0140708 | A1 * | 6/2006 | Byun | A45D 34/042 401/270 |

* cited by examiner

*Primary Examiner* — Jennifer C Chiang

(57) ABSTRACT

A cosmetic container includes an enclosure stored with cosmetic contents; a sleeve including an externally and internally extending rim at one end of a hollow cylinder, an extension at the other end of the hollow cylinder, at least one port through the extension, and at least one valve in the at least one port respectively; a spring biased plunger including a hollow cylindrical member, a disc shaped member at one end of the hollow cylindrical member, a hollow cylindrical element in the hollow cylindrical member, a stem extending forward from the disc shaped member, and an axial tunnel through the stem to communicate with the hollow cylindrical element; a hollow mount including an axial passageway placed on the stem and communicating with the tunnel; a hollow fibrous applicator with the mount disposed therein, and front opening members communicating with the passageway; and a cap releasably secured to the enclosure.

6 Claims, 4 Drawing Sheets

COSMETIC CONTAINER HAVING A FIBROUS APPLICATOR

BACKGROUND OF THE INVENTION

1. Field of the Invention

The invention relates to cosmetic containers and more particularly to a cosmetic container which after use and being closed, the unused lotion in the enclosure is prevented from being contaminated by the lotion exposed to the air in the opening members of the fibrous applicator because each valve is closed by the spring biased plunger.

2. Description of Related Art

Conventionally, in using a cosmetic container, a person may remove the cap, hold the enclosure with one hand, and incline the enclosure to cause lotion in the reservoir of the container to flow out of the tip for application. After use, the person may put the cap on the enclosure by threading. And in turn, the lotion may flow back into the reservoir.

However, the flowed back lotion may be contaminated after use. Further, the flowed back lotion may contaminate the unused lotion by mixing with it. It has the drawbacks of causing inconvenience and harming the skin by applying the contaminated lotion thereto. Further, the tip of the conventional cosmetic container cannot be replaced with one having a different shape. Further, the tip is somewhat rigid and it may cause discomfort to the skin when rubbing thereon.

Thus, the need for improvement still exists.

SUMMARY OF THE INVENTION

It is therefore one object of the invention to provide a cosmetic container comprising an enclosure including an internal space and an opening; a sleeve including a hollow cylinder, an externally and internally extending rim at one end of the hollow cylinder, an extension at the other end of the hollow cylinder, a channel formed through the hollow cylinder, at least one port formed through the extension, and at least one valve each disposed in one of the at least one port wherein the sleeve is fitted in the opening with the externally and internally extending rim engaging the opening; a plunger including a hollow cylindrical member, a disc shaped member formed at one end of the hollow cylindrical member, a hollow cylindrical element formed in the hollow cylindrical member and extending rearward, a stem extending forward from a center of the disc shaped member, and an axial tunnel formed through the stem to communicate with the hollow cylindrical element; a biasing member disposed in an annular gap between the hollow cylindrical element and the hollow cylindrical member; a hollow mount including an axial passageway placed on the stem and communicating with the axial tunnel, and an annular flange member formed on an outer surface; a resilient, hollow fibrous applicator including an internal space member with the hollow mount disposed therein and the annular flange member fastened therein, and a plurality of opening members formed on a front end, the opening members communicating with the passageway; and a cap releasably secured to the opening of the enclosure; wherein the hollow cylindrical element is configured to open or close the at least one valve.

Preferably, further comprises a plurality of elongated projections formed on an inner surface of the hollow cylinder, at least one groove each formed between two adjacent ones of the elongated projections, and at least one ridge formed on an outer surface of the hollow cylindrical member, each of the at least one ridge being slidably disposed in one of the at least one groove.

Preferably, a diameter of the hollow cylindrical element is less than that of the hollow cylindrical member, and wherein the biasing member has one end urging against an inner surface of the disc shaped member and the other end urging against a rear end of the channel.

Preferably, the plunger further comprises an annular flange formed on an outer surface of the hollow cylindrical member, and wherein the annular flange slidably engages an inner surface of the hollow cylinder and is not allowed to move to pass the externally and internally extending rim.

Preferably, a diameter of the hollow cylindrical element is less than that of the extension, and wherein an outer surface of a rear portion of the hollow cylindrical element is slidably disposed in the extension.

Preferably, the fibrous applicator is shaped as a sphere, cube, cone or pyramid.

Preferably, the fibrous applicator can be colorful.

Preferably, the fibrous applicator is replaceable.

The invention has the following advantages and benefits in comparison with the conventional art: After use and closing the enclosure, the unused lotion in the enclosure is prevented from being contaminated by the lotion exposed to the air in the opening members because each valve is closed by the spring biased plunger.

The above and other objects, features and advantages of the invention will become apparent from the following detailed description taken with the accompanying drawings.

DETAILED DESCRIPTION OF THE INVENTION

Figure 1:
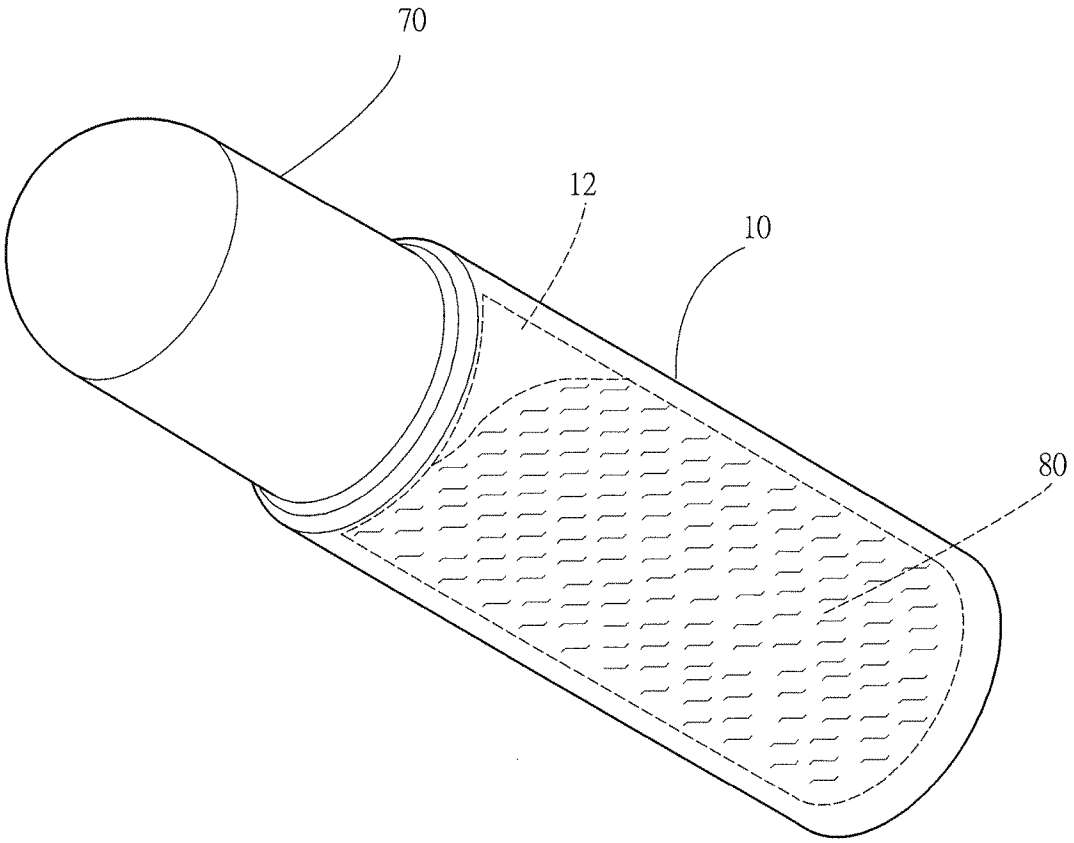
FIG. 1 is a perspective view of a cosmetic container according to the invention.
Figure 2:
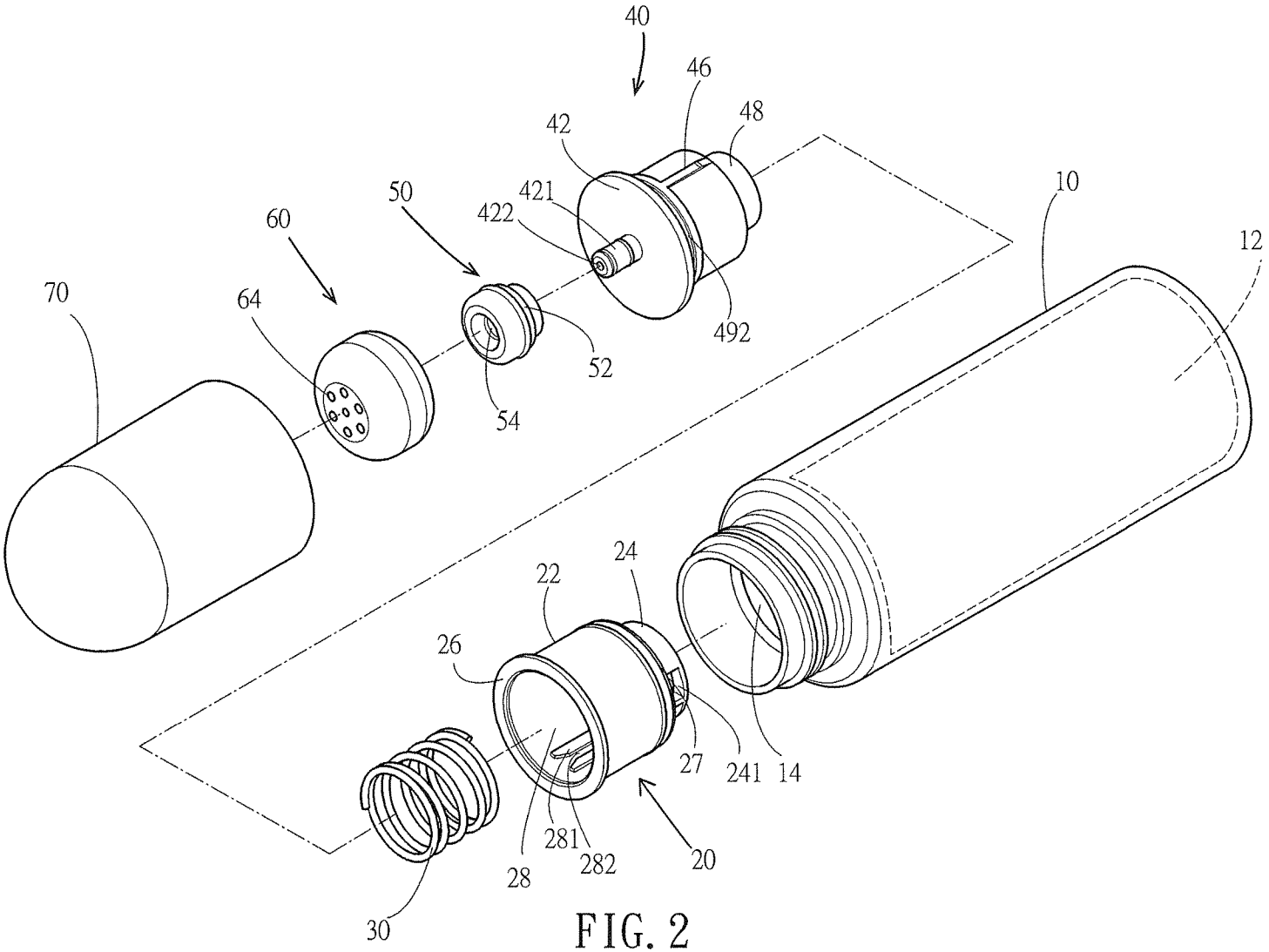
FIG. 2 is an exploded view of the cosmetic container.

Referring to FIGS. 1 to 4, a cosmetic container in accordance with the invention comprises the following components as discussed in detail below.

An enclosure 10 includes an internal space 12, an opening 14, and threads 11 on an outer surface of the opening 14. A sleeve 20 includes a hollow cylinder 22, an externally and internally extending rim 26 at one end of the hollow cylinder 22, an extension 24 at the other end of the hollow cylinder 22, a channel 28 formed through the hollow cylinder 22, two elongated projections 281 formed on an inner surface of the hollow cylinder 22, a groove 282 formed between the projections 281, a plurality of ports 241 formed through the extension 24, and a plurality of valves 27 each provided in the port 241. The sleeve 20 is fitted in the opening 14 with the rim 26 engaging the mouth of the opening 14.

A plunger 40 includes a hollow cylindrical member 44, a ridge 46 formed on an outer surface of the hollow cylindrical member 44 and slidably disposed in the groove 282, a disc shaped member 42 at one end of the hollow cylindrical member 44, a concentric hollow cylindrical element 48 formed in the hollow cylindrical member 44 and extending rearward, a stem 421 extending forward from a center of the disc shaped member 42, an axial tunnel 422 formed through the stem 421 to communicate with the hollow cylindrical element 48, and an annular flange 492 formed on a front portion of an outer surface of the hollow cylindrical member 44. The flange 492 slidably engages an inner surface of the hollow cylinder 22. The flange 492 is not allowed to move to pass the rim 26. A biasing member 30 (shch as a torsion spring 30 in this embodiment) is disposed in an annular gap 491 between the hollow cylindrical element 48 and the hollow cylindrical member 44. The torsion spring 30 has one end urging against an inner surface of the disc shaped member 42 and the other end urging against a rear end of the channel 28 (i.e., at a shoulder between the extension 24 and the hollow cylinder 22). A diameter of the hollow cylindrical element 48 is less than that of the hollow cylindrical member 44. The diameter of the hollow cylindrical element 48 is less than that of the extension 24. An outer surface of a rear portion of the hollow cylindrical element 48 is slidably disposed in the extension 24 near the valves 27.

A hollow mount 50 includes an axial passageway 54 placed on the stem 421, and an annular flange member 52 on an outer surface. A hollow fibrous applicator 60 is resilient and includes an internal space member 62 with the mount 50 disposed therein and the flange member 52 fastened therein. The fibrous applicator 60 further includes a plurality of opening members 64 on a front end. The opening members 64 communicate with the passageway 54 which in turn communicates with the tunnel 422. The fibrous applicator 60 can be shaped as a sphere, cube, cone or pyramid. The fibrous applicator 60 can be colorful. The fibrous applicator 60 is replaceable. A cap 70 includes an internally threaded section 72 adjacent to a rear end. The internally threaded section 72 is secured to the threads 11 in a closed state of the cosmetic container.

A manufacturing process of the fibrous applicator 60 includes applying oil based additive on an outer surface of the fibrous applicator 60, placing the fibrous applicator 60 in a static pile planting device, and activating the static pile planting device to securely plant pile on the fibrous applicator 60 by adhering to the oil based additive. The openings 64 are not blocked in the pile planting step.

Figure 3:
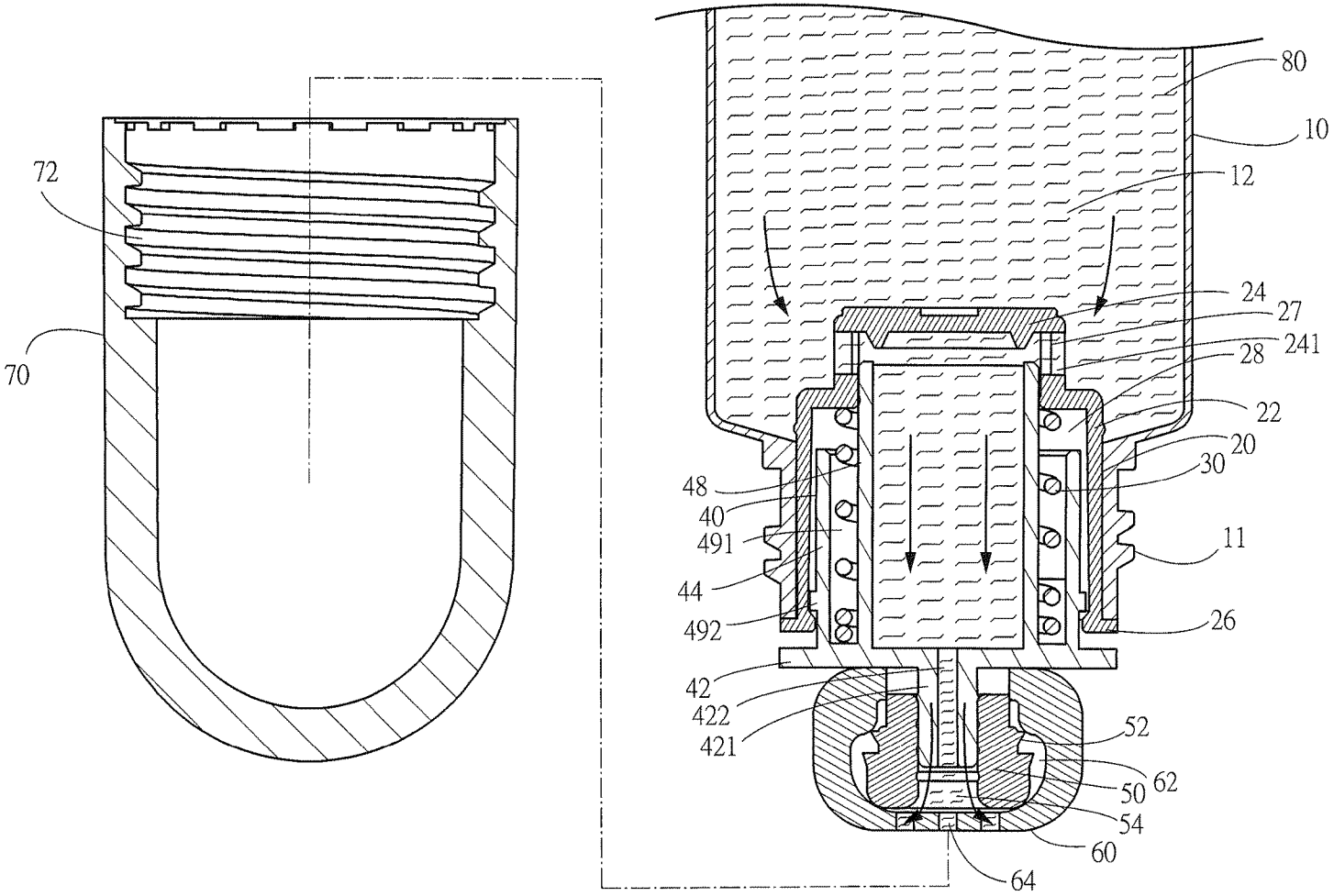
FIG. 3 is a longitudinal sectional view of the cosmetic container with the cap removed to flow lotion out of the cosmetic container in use.

As shown in FIG. 3 specifically, lotion 80 is stored in the space 12. In an open state of the cosmetic container, the cap 70 is removed, the plunger 40 is pushed forward by the expanding torsion spring 30 until the flange 492 is stopped by the rim 26, the hollow cylindrical element 48 is also pushed forward in the channel 28 to unblock the valves 27, and the lotion 80 flows out of the openings 64 (see arrows) via the open valves 27, the hollow cylindrical element 48, the tunnel 422 and the passageway 54. The discharged lotion 80 can be applied to the skin by rubbing the fibrous applicator 60 on the skin.

Figure 4:
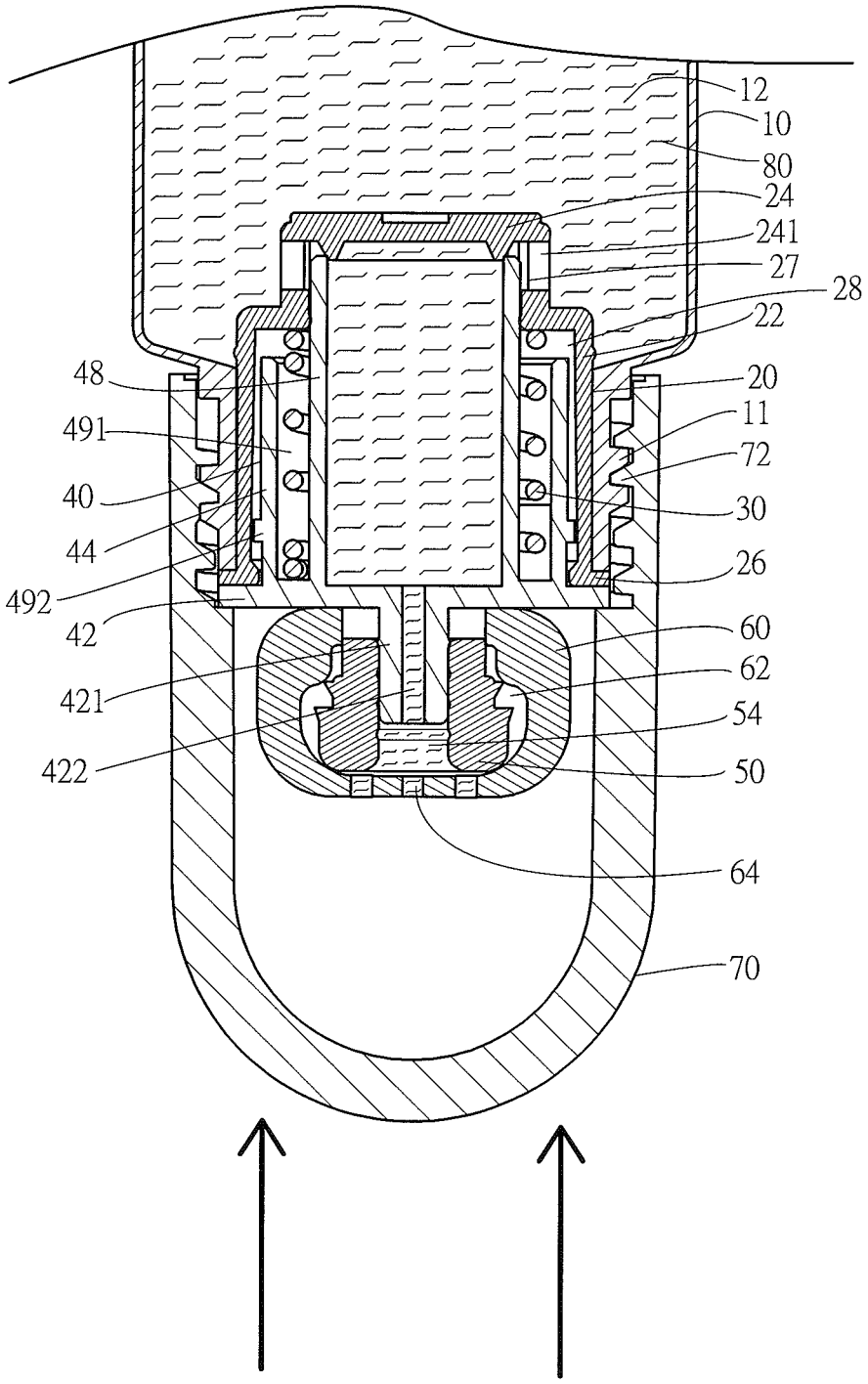
FIG. 4 is a longitudinal sectional view of the cosmetic container with the cap put on again after use.

As shown in FIG. 4 specifically, in a closed state of the cosmetic container, the cap 70 is secured to the enclosure 10 by threadedly fastening the internally threaded section 72 and the threads 11 together, the plunger 40 is pushed rearward with the torsion spring 30 being compressed, and the hollow cylindrical element 48 is also pushed rearward until the valves 27 are blocked. It is envisaged by the invention that the lotion 80 in the openings 64 is prevented from being mixed with the lotion 80 in the space 12 by flowing back via the passageway 54, the tunnel 422, the hollow cylindrical element 48, and the closed valves 27 because the valves 27 are blocked (i.e., closed). This has the advantage of preventing the unused lotion 80 in the space 12 from being contaminated by the lotion 80 exposed to the air in the openings 64.

While the invention has been described in terms of preferred embodiments, those skilled in the art will recognize that the invention can be practiced with modifications within the spirit and scope of the appended claims.

What is claimed is:

1. A cosmetic container comprising:

an enclosure including an internal space and an opening;

a sleeve including a hollow cylinder, an externally and internally extending rim at one end of the hollow cylinder, an extension at the other end of the hollow cylinder, a channel formed through the hollow cylinder, at least one port formed through the extension, and at least one valve each disposed in one of the at least one port wherein the sleeve is fitted in the opening with the externally and internally extending rim engaging the opening;

a plunger including a hollow cylindrical member, a disc shaped member formed at one end of the hollow cylindrical member, a hollow cylindrical element formed in the hollow cylindrical member and extending rearward, a stem extending forward from a center of the disc shaped member, and an axial tunnel formed through the stem to communicate with the hollow cylindrical element;

a biasing member disposed in an annular gap between the hollow cylindrical element and the hollow cylindrical member;

a hollow mount including an axial passageway placed on the stem and communicating with the axial tunnel, and an annular flange member formed on an outer surface;

a resilient, hollow fibrous applicator including an internal space member with the hollow mount disposed therein and the annular flange member fastened therein, and a plurality of opening members formed on a front end, the opening members communicating with the passageway; and a cap releasably secured to the opening of the enclosure;

wherein the hollow cylindrical element is configured to open or close the at least one valve.

2. The cosmetic container of claim 1, further comprising a plurality of elongated projections formed on an inner surface of the hollow cylinder, at least one groove each formed between two adjacent ones of the elongated projections, and at least one ridge formed on an outer surface of the hollow cylindrical member, each of the at least one ridge being slidably disposed in one of the at least one groove.

3. The cosmetic container of claim 1, wherein a diameter of the hollow cylindrical element is less than that of the hollow cylindrical member, and wherein the biasing member has one end urging against an inner surface of the disc shaped member and the other end urging against a rear end of the channel.

4. The cosmetic container of claim 1, wherein the plunger further comprises an annular flange formed on an outer surface of the hollow cylindrical member, and wherein the annular flange slidably engages an inner surface of the hollow cylinder and is not allowed to move to pass the externally and internally extending rim.

5. The cosmetic container of claim 1, wherein a diameter of the hollow cylindrical element is less than that of the extension, and wherein an outer surface of a rear portion of the hollow cylindrical element is slidably disposed in the extension.

6. The cosmetic container of claim 1, wherein the fibrous applicator is shaped as a sphere, cube, cone or pyramid.

* * * * *